US006016030A

United States Patent [19]

Amano et al.

[11] Patent Number: 6,016,030

[45] Date of Patent: Jan. 18, 2000

[54] COLOR CATHODE-RAY TUBE WITH INTERMEDIATE ELECTRODE

[75] Inventors: Yasunobu Amano, Toyko; Koji Ichida, Kanagawa; Naruhiko Endo, Fukushima; Yoichi Ohshige; Masahiko Mizuki, both of Kanagawa, all of Japan

[73] Assignee: Sony Corporation, Japan

[21] Appl. No.: 08/820,657

[22] Filed: Mar. 18, 1997

[30] Foreign Application Priority Data

| | | | |
|---|---|---|---|
| Mar. 26, 1996 | [JP] | Japan | 8-070466 |
| Jan. 30, 1997 | [JP] | Japan | 9-016767 |

[51] Int. Cl.[7] ..... H01J 29/51

[52] U.S. Cl. ..... 313/414; 315/15

[58] Field of Search ..... 313/412, 414, 313/421, 425, 429, 456, 457; 315/3, 14, 15, 16, 382, 382.1, 52

[56] References Cited

U.S. PATENT DOCUMENTS

| | | | |
|---|---|---|---|
| Re. 35,548 | 7/1997 | Sluyterman et al. | 315/368.28 |
| 4,124,810 | 11/1978 | Bortfeld et al. | 315/15 |
| 4,243,911 | 1/1981 | Winarsky et al. | 315/3 |
| 4,374,341 | 2/1983 | Say | 313/414 |
| 4,639,640 | 1/1987 | Hata et al. | 315/3 |
| 4,786,842 | 11/1988 | Shimoma et al. | 315/3 |
| 5,212,423 | 5/1993 | Noguchi et al. | 313/414 |
| 5,399,946 | 3/1995 | Son et al. | 315/382 |
| 5,406,169 | 4/1995 | Son | 313/414 |
| 5,621,286 | 4/1997 | Toujou et al. | 315/368.1 |
| 5,670,841 | 9/1997 | Muti et al. | 313/412 |
| 5,675,211 | 10/1997 | Ueda | 313/412 |
| 5,677,591 | 10/1997 | Toujou et al. | 313/414 |

FOREIGN PATENT DOCUMENTS

| | | | |
|---|---|---|---|
| 0 315 269 | 5/1989 | European Pat. Off. | H01J 29/51 |
| 0 646 944 | 4/1995 | European Pat. Off. | H01J 29/50 |
| 0 655 764 | 5/1995 | European Pat. Off. | H01J 29/50 |
| 0 692 811 | 1/1996 | European Pat. Off. | H01J 29/50 |
| 61-131342 | 6/1986 | Japan | H01J 29/50 |
| 04133247 | 5/1992 | Japan | H01J 29/50 |

*Primary Examiner*—Sandra O'Shea
*Assistant Examiner*—Michael Day
*Attorney, Agent, or Firm*—Rader, Fishman, & Grauer; Ronald P. Kananen

[57] ABSTRACT

To propose a color cathode-ray tube which increases the degree of freedom in designing its main electron lens, decreases the electron beam spot diameter, and achieves high resolution, in which between the focusing electrode (15) applied with the focusing voltage (Vf) and the anode electrode (17) applied with the anode voltage (Va), there is provided the intermediate electrode (16) applied with the potential Vm which is higher than the focusing voltage (Vf) and lower than the anode voltage (Va), and the focusing electrode (15), the anode electrode (17) and the intermediate electrode (16) are respectively formed of cylindrical bodies each having an ellipse cross-section and closed by the electric field correcting electrode plates (25, 26, 27, 28) having three electron beam penetrating portions bored therethrough so as to be arrayed in an in-line fashion.

10 Claims, 14 Drawing Sheets

COLOR CATHODE-RAY TUBE WITH INTERMEDIATE ELECTRODE

BACKGROUND

1. Field of the Invention

The present invention generally relates to a color cathode-ray tube in which a diameter of a beam spot is reduced to achieve high resolution over the entire screen. More particularly, the present invention relates to an arrangement of electrodes of an electron gun forming a main electron lens and an incorporated dividing resistor for applying an intermediate voltage to an intermediate electrode constituting the electron gun.

2. Background of the Invention

Recently, a color cathode-ray tube is more and more requested to be capable of providing an image of high resolution. One of the most decisive factor for determining the resolution is the diameter of a beam spot or a beam spot diameter formed on the screen (phosphor screen). Therefore, the beam spot of an electron gun is requested to be reduced as much as possible.

The beam spot diameter is normally expressed by the following equation (1).

$$\text{Beam spot diameter}=\{(M\times d+\tfrac{1}{2}\times M\times C_s\times\theta^3)^2+\text{Rep}^2\}^{1/2} \quad (1)$$

where

M: image magnification d: virtual object point diameter $C_s$: spherical aberration coefficient θ: divergence angle Rep: electron repulsion It is understood from the above equation (1) that in order to make the beam spot diameter small, it is effective to reduce the spherical aberration coefficient $C_s$ of the main focusing lens. For reducing the beam spot diameter, under the restriction imposed on designing the neck diameter, an aperture of the electron lens of the electron gun should be made as large as possible to reduce the spherical aberration upon stopping the beam.

There has been proposed a prior art such as one disclosed in Gazette of Japanese Laid-open Patent Publication No. 61-131342, for example, in which an arrangement is proposed to produce a main lens electric field with a large aperture. FIG. 1 is a diagram showing the arrangement of electrodes of an electron gun of a cathode-ray tube disclosed therein. The electron gun has a focusing electrode 105 applied with a focusing voltage Vf and an anode electrode 106 applied with an anode voltage Va in order to form a main electron lens. The focusing electrode 105 is formed of a cylindrical body 113 with an elliptical cross-section closed by an auxiliary electrode plate 114 which has three electron beam penetrating apertures 114*a*, 114*b*, 114*c* bored therethrough. Similarly, the anode electrode 106 is formed of a cylindrical body 115 with an elliptical cross-section closed by an auxiliary electrode 116 which has electron beam penetrating apertures 116*a*, 116*b*, 116*c* bored therethrough. Then, three adjacent main electric fields, which are produced between three electron beam penetrating apertures 114*a*, 114*b*, 114*c* and three electron beam penetrating apertures 116*a*, 116*b*, 116*c*, are partly overlapped. In this manner, a main lens electric field of a large aperture is produced.

Another arrangement of electrodes has been proposed in Gazette of Japanese Laid-open Patent Publication No. 8-22780, to enlarge the aperture of the main electron lens.

FIG. 2 is a diagram showing such arrangement of electrodes of an electron gun of the cathode-ray tube disclosed therein. As shown in FIG. 2, the arrangement of the electrodes includes an intermediate electrode 109 formed of a cylindrical body with an elliptical cross-section interposed coaxially between the focusing electrode 105 and the anode electrode 106. The intermediate electrode 109 is applied with a potential Vm which is intermediate between the anode voltage Va and the focusing voltage Vf. Thus, the aperture of the main lens electric field is further enlarged.

In the arrangement of FIG. 2, if the intermediate electrode 109 is further elongated, then the aperture of the main lens electric field can be further enlarged. However, if the electrode is made long, the electric field effected over the focusing electrode 105, the intermediate electrode 109 and the anode electrode 106 becomes feeble. Therefore, it becomes difficult to satisfy requirements in the shape and convergence of the three beams at the same time by arranging only the auxiliary electrodes 114, 116 which close the focusing electrode 105 and the anode electrode 106, respectively. Specifically, the electric fields cannot sink deeply into the beam penetrating apertures 114*a* to 114*c* and 116*a* to 116*c* of the auxiliary electrodes 114, 116, and hence correction effect owing to the lens produced here, i.e., the correction sensitivity becomes low. For this reason, it becomes difficult to satisfy the both requirements, i.e., to keep the spot shape and convergence optimally. Accordingly, the intermediate electrode cannot be elongated unlimitedly.

OBJECT AND SUMMARY OF THE INVENTION

Therefore, it is a general object of the present invention to provide an improved color cathode-ray tube in which the aforesaid shortcomings and disadvantages encountered with the prior art can be eliminated.

More specifically, it is an object of the present invention to provide a color cathode-ray tube in which freedom in designing the electron gun is increased, so that the intermediate electrode can be elongated while requirements in beam shape and convergence are satisfactorily maintained, whereby the spherical aberration coefficient is further reduced and resolution is increased. In conjunction with the arrangement of the above object, it is expected that the electron gun can be assembled more accurately.

According to a first aspect of the present invention, there is provided an arrangement having a focusing electrode applied with a focusing voltage, an anode electrode applied with an anode voltage, and an intermediate electrode disposed between the focusing electrode and the anode electrode and applied with an intermediate voltage which is higher than the focusing voltage and lower than the anode voltage, wherein each of the focusing electrode, the anode electrode and the intermediate electrode is formed of a cylindrical body of an elliptical cross-section closed by an electric field correcting electrode plate having three electron beam penetrating portions bored so as to be arrayed in an in-line fashion.

According to the above arrangement of the first aspect of the present invention, each of the focusing electrode, the anode electrode, the intermediate electrode disposed between the focusing electrode and the anode electrode and applied with the voltage between the focusing voltage and the anode voltage, is formed of a cylindrical body having an electric field correcting electrode plate. Therefore, the electric field will sink into the beam penetrating portion of the electric field correcting electrode plate of the intermediate electrode, which fact results in formation of a new lens that can control the shape and convergence of the beams. Owing to the newly formed lens, it is possible to increase freedom in designing the electron gun so as to elongate the intermediate electrode while satisfy both the requirements in keeping the beam shape and convergence optimally. As a result, it is possible to produce a gentle slope in the potential distribution on the axis of the main electron lens. Accordingly, an effective aperture of the main electron lens can be enlarged, and the spherical aberration coefficient can be further reduced.

Moreover, by using the beam penetrating portions of the electric field correcting electrode plates of the focusing electrode, the anode electrode and the intermediate electrode, the group of electrodes forming the main electron lens can be assembled with higher accuracy.

According to the second aspect of the present invention, there is provided an arrangement having a focusing electrode, an anode electrode, an intermediate electrode disposed between the focusing electrode and the anode electrode and an incorporated dividing resistor, wherein a first terminal of the incorporated dividing resistor is connected to the anode electrode, a second terminal of the incorporated dividing resistor is connected to the focusing electrode, and a third terminal between the first terminal and the second terminal is connected to the intermediate electrode, whereby an intermediate voltage between the focusing voltage and the anode voltage is applied to the intermediate electrode.

According to the above arrangement of the second aspect of the present invention, the whole length of the incorporated dividing resistor can be made short. For this reason, metal bodies, which are provided for depositing a metal film for stabilizing the potential distribution within the neck portion and suppressing discharge, can be wound in a symmetrical fashion around the bead glass bodies which are disposed in an opposing fashion. Thus, the cathode-ray tube is made to have a stable characteristic, and the electron gun thereof is made to have a lens of a large diameter.

According to the third aspect of the present invention, there is provided an arrangement having a focusing electrode, an anode electrode, an intermediate electrode disposed between the focusing electrode and the anode electrode and applied with an intermediate voltage, which falls within an range between the focusing voltage and the anode voltage, through an incorporated dividing resistor, wherein the incorporated dividing resistor is formed to have a width constricted portion and a metal body is wound around the incorporated dividing resistor at the width constricted portion.

According to the above arrangement of the third aspect of the present invention, the metal body is wound at the width constricted portion of the incorporated dividing resistor which is provided on one of the bead glass body. Thus, the respective distances between the metal bodies wound around the bead glass bodies and the respective inner wall of the neck become virtually equal to each other. Therefore, when heat is applied to the metal body to effect evaporation, it can be expected for metal films to be deposited equivalently on both of the opposing sides of the neck portion, i.e., one side on which the incorporated dividing resistor is provided and the other side on which there is no incorporated dividing resistor provided. Accordingly, satisfactory and stable voltage withstand characteristic can be obtained. At the same time, since a space is secured between the metal body and the inner wall of the neck portion, the electron gun is made to have a lens of a large diameter.

The above and other objects, features, and advantages of the present invention will become apparent from the following detailed description of an illustrative embodiments thereof to be read in conjunction with the accompanying drawings, in which like reference numerals are used to identify the same or similar parts in the several views.

DETAILED DESCRIPTION OF THE PREFERRED EMBODIMENTS

According to the present invention, a color cathode-ray tube has an arrangement in which, between a focusing electrode applied with a focusing voltage and an anode electrode applied with an anode voltage, there is provided an intermediate electrode maintained to have a potential which is higher than the focusing voltage and lower than the anode voltage, wherein each of the focusing electrode, the anode electrode and the intermediate electrode is comprised of a cylindrical body with an ellipse cross-section closed by an electric field correcting electrode plate having three electron beam penetrating portions bored so as to be arrayed in an in-line fashion.

As the electric field correcting electrode plate, at least one electric field correcting electrode plates is disposed at a position recessed from the opening of the cylindrical body.

Figure 21:
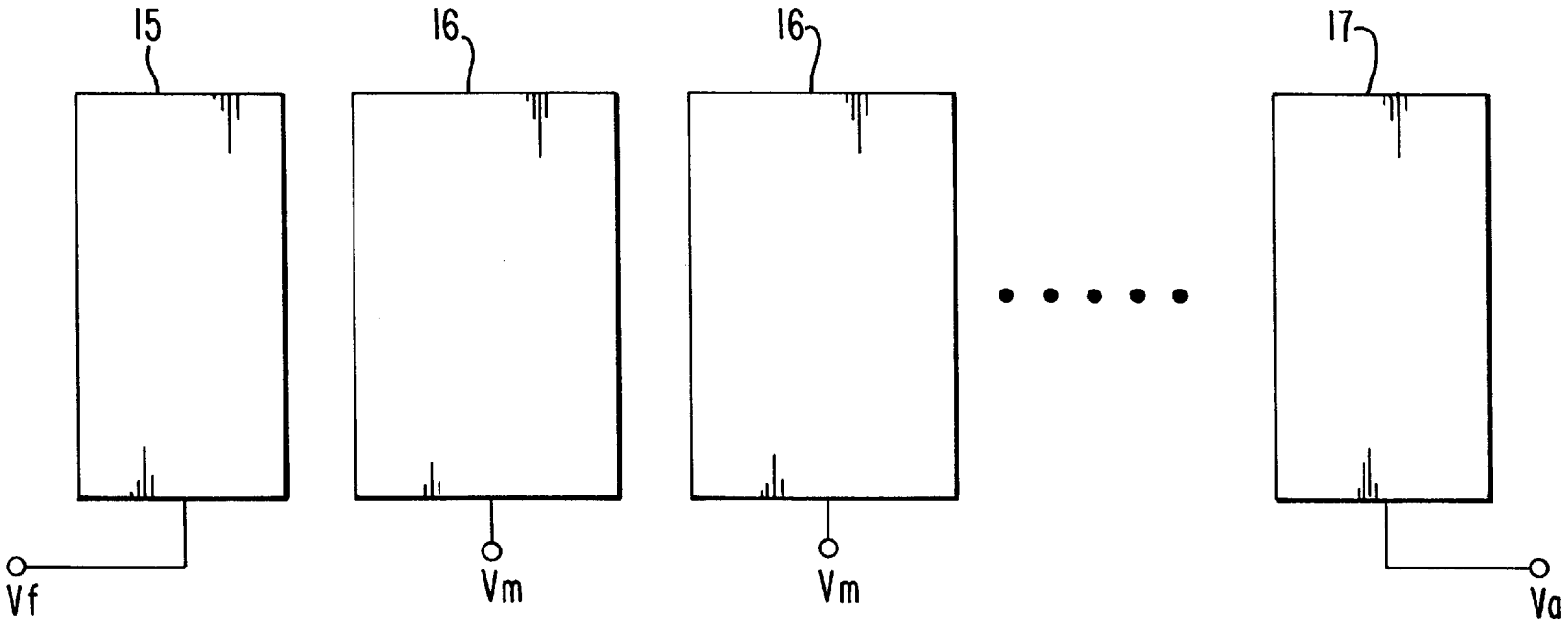
FIG. 21 is a constructional diagram of a plurality of intermediate electrodes arranged between a focusing electrode and an anode electrode.

One or more intermediate electrodes are provided between the focusing electrode and the anode electrode as shown in FIG. 21.

The intermediate electrode has one or two electric field correcting plates provided.

It is desirable that the electric field correcting electrode plate of the intermediate electrode is provided at a position of the intermediate electrode shifted from a position on an axis corresponding to a potential of the intermediate electrode on the axis of the potential distribution which is determined by the potential of the focusing electrode, the potential of the intermediate electrode and the potential of the anode electrode.

The intermediate electrode may be maintained to have the potential by applying to the intermediate electrode a voltage which is higher than the focusing voltage and lower than the anode voltage.

The intermediate electrode may be maintained to have the potential by a free potential induced by the focusing voltage and the anode voltage.

According to the cathode-ray tube of the present invention, there is provided an arrangement in which between a focusing electrode applied with a focusing voltage and an anode electrode applied with an anode voltage, an intermediate electrode applied with an intermediate voltage between the focusing voltage and the anode voltage is provided, a first terminal of an incorporated dividing resistor is connected to the anode electrode, a second terminal of the same is connected to the focusing electrode, and the intermediate voltage is supplied from a third terminal between the first terminal and the second terminal to the intermediate electrode.

According to the cathode-ray tube of the present invention, there is provided an arrangement in which between a focusing electrode applied with a focusing voltage and an anode electrode applied with an anode voltage, an intermediate electrode applied with an intermediate voltage between the focusing voltage and the anode voltage is provided, the intermediate voltage is applied through an incorporated dividing resistor to the intermediate electrode, and a metal body is wound around a width constricted portion of the incorporated dividing resistor.

An embodiment of the present invention will hereinafter be described with reference to the drawings.

Figure 3:
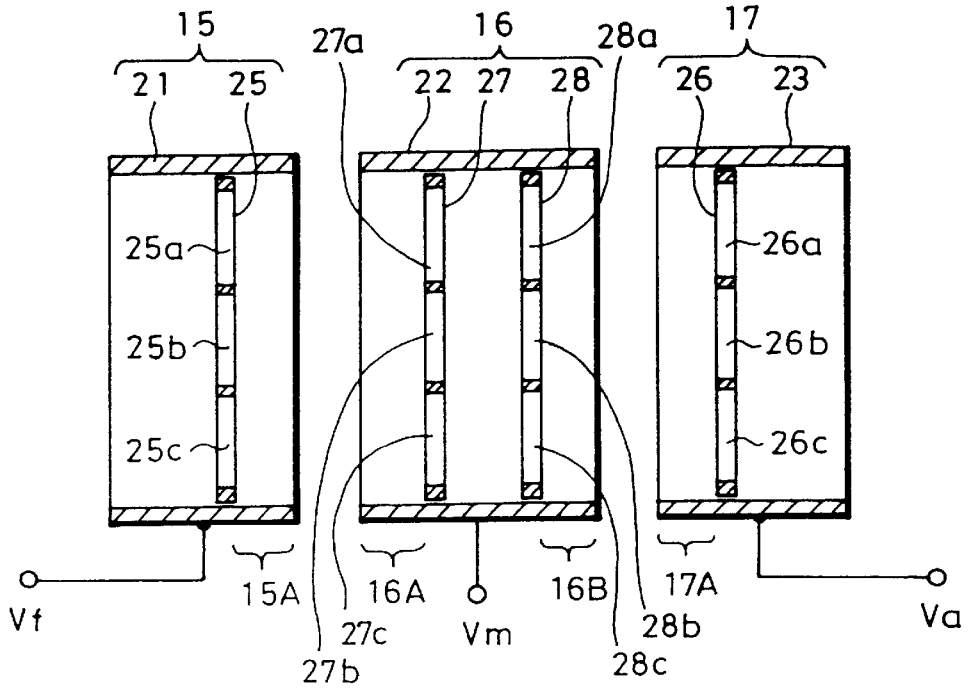
FIG. 3 is a constructional diagram showing one example of a group of electrodes of the electron gun forming a main electron lens according to the present invention.
Figure 4A:
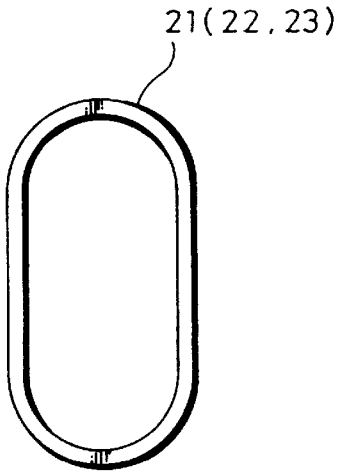
FIGS. 4A and 4B are a front view showing one example of a shape of a cylindrical body of the electrode forming the main electron lens of FIG. 3, and a front view showing one example of an electric field correcting electrode plate of FIG. 3, respectively.

FIG. 3 shows one embodiment of the present invention. In the present embodiment, between a focusing electrode (e.g., a fifth electrode) 15 applied with a focusing voltage Vf and an anode electrode (e.g., a seventh electrode) 17 applied with an anode voltage Va, there is disposed an intermediate electrode (e.g., a sixth electrode) 16 applied with an intermediate voltage Vm which is lower than the anode voltage Va and higher than the focusing voltage Vf. The focusing electrode 15, the intermediate electrode 16 and the anode electrode 17 are formed of cylindrical bodies 21, 22 and 23, respectively, as shown in FIG. 4A, and they are disposed coaxially.

Figure 4B:
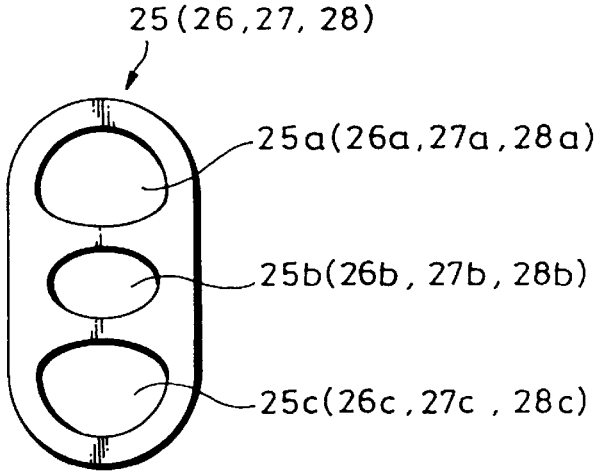

The focusing electrode 15 is closed by an electric field correcting electrode plate 25 disposed at a position recessed inward from the opening portion of the cylindrical body 21. As shown in FIG. 4B, the electric field correcting electrode plate 25 has three electron beam penetrating portions, in this example, electron beam penetrating apertures 25*a*, 25*b*, 25*c*, arrayed in an in-line fashion.

The central electron beam penetrating aperture 25*b* is formed into an elliptical shape with a longitudinal axis extending in the vertical direction, for example, and the electron beam penetrating apertures 25*a*, 25*c* on the both sides thereof are formed into a shape surrounded with an arc and an elliptical arc, for example. Alternatively, the electron beam penetrating apertures 25*a*, 25*c* on the both sides may be formed into a circular shape through which the penetrating beam passes at a position displaced from the center of the circle. The electron beam penetrating apertures 25*a*, 25*b*, 25*c* may have other shapes.

Similarly to the focusing electrode 15, the anode electrode 17 is closed by an electric field correcting electrode plate 26 disposed at a position recessed inward from the opening portion of the cylindrical body 23. As shown in FIG. 4B, the electric field correcting electrode plate 26 has three electron beam penetrating portions, in this example, electron beam penetrating apertures 26*a*, 26*b*, 26*c*, arrayed in an in-line fashion.

The intermediate electrode 16 is formed to be closed by two sheets of electric field correcting electrode plates 27 and 28 disposed at positions recessed inward from the opening portions on the focusing electrode 15 side and the anode electrode 17 side of the cylindrical body 22. As shown in FIG. 4B, each of the electric field correcting electrode plates 27, 28 has electron beam penetrating portions, in this example, electron beam penetrating apertures 27*a*, 27*b*, 27*c* and 28*a*, 28*b*, 28*c*, arrayed in an in-line fashion.

The focusing electrode 15, the intermediate electrode 16 and the anode electrode 17 form the main electron lens (main focusing lens).

Figure 5:
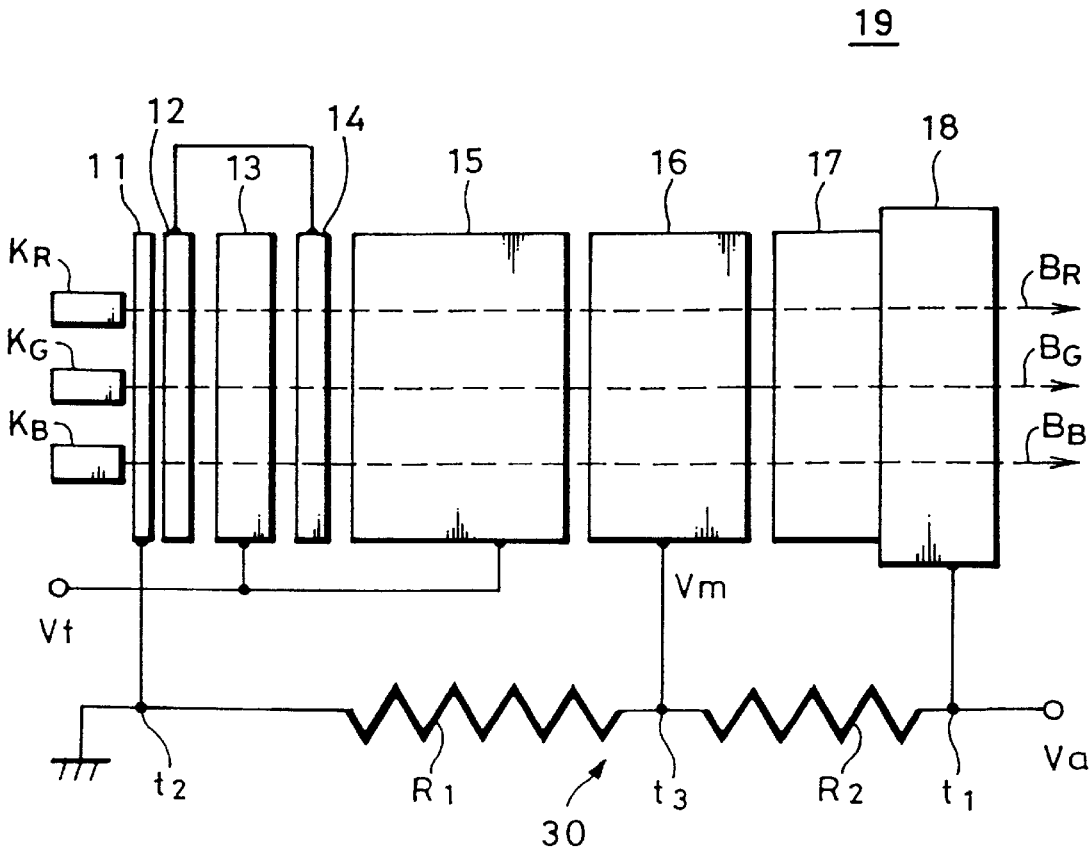
FIG. 5 is a constructional diagram showing one example of the electron gun according to the present invention.

The focusing electrode 15, the intermediate electrode 16 and the anode electrode 17 forming the main electron lens constitute an electron gun 19 together with three cathodes and other electrodes, as shown in FIG. 5.

Specifically, three cathodes $K_R$, $K_G$ and $K_B$ corresponding to red, green, blue are arrayed in an in-line fashion, and a first electrode 11, a second electrode 12, a third electrode 13, a fourth electrode 14, the fifth electrode (focusing electrode) 15, the six electrode (intermediate electrode) 16 and the seventh electrode (anode electrode) 17 are arrayed sequentially and coaxially so that they commonly serve for the three cathodes $K_R$, $K_G$ and $K_B$. A shield cup 18 is disposed at the final stage to construct a three beam single electron gun 19 of a unibipotential type added with an electric field expansion lens (potential on the axis is gentle) as will be apparent later on. Although not shown, an end plate of each of the first electrode 11, the second electrode 12, the third electrode 13, the fourth electrode 14, and an end plate of the fifth electrode 15 on the fourth electrode side are provided with electron beam penetrating apertures through which the respective electron beams $B_R$, $B_G$ and $B_B$ penetrate. The second electrode 12 and the fourth electrode 14 are applied with the same potential while the third electrode 13 and the fifth electrode 15 are applied with the focusing potential.

In the electron gun 19, the respective electron beams $B_R$, $B_G$ and $B_B$ generated and controlled by the cathodes $K_R$, $K_G$ and $K_B$ and the first electrode 11 and the second electrode 12 are subjected to adjustment in divergence angle by a front stage electron lens (front stage focusing lens) which is formed by the third electrode 13, the fourth electrode 14 and fifth electrode (focusing electrode) 15. Thereafter, the electron beams are converged by the main electron lens (main focusing lens) which is constructed by the fifth electrode (focusing electrode) 15, the sixth electrode (intermediate electrode) 16 and the seventh electrode (anode electrode) 17.

The intermediate electrode 16 is applied with a voltage in a manner similar to that in which the focusing electrode 15 is applied with a voltage. Alternatively, as shown in FIG. 5, the intermediate electrode 16 may be applied with a voltage which is generated by dividing a high voltage by an internal dividing resistor 30. The internal dividing resistor 30 is formed of resistor patterns $R_1$, $R_2$ printed on a ceramic substrate, for example. One ends of the resistor patterns $R_1$, $R_2$ are connected to the anode electrode 17 of high voltage and the other ends of the resistor patterns $R_1$, $R_2$ are grounded. An intermediate voltage Vm obtained at an intermediate point between the resistor patterns $R_1$ and $R_2$ is applied to the intermediate electrode 16.

Conversely, the intermediate electrode 16 may not be applied with a voltage but can be maintained at a free potential which is induced by the anode voltage Va applied to the anode electrode 17 and the focusing voltage Vf applied to the focusing electrode 15.

A specification of one example of the electron gun 19 will be shown below.

Figure 6:
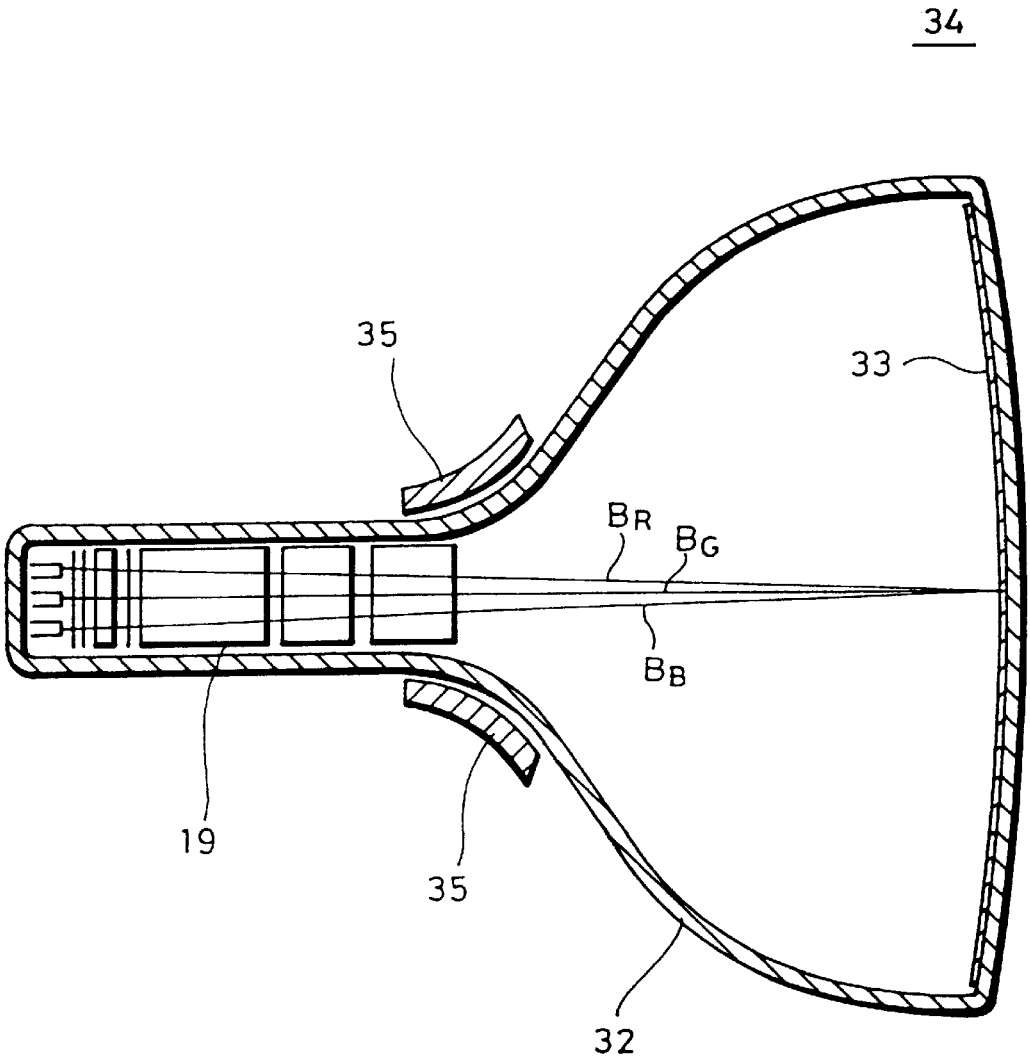
FIG. 6 is a constructional diagram showing one example of a color cathode-ray tube according to the present invention.

- the length of the intermediate electrode 16: 10 mm
- the distance between the focusing electrode 15 and the intermediate electrode 16: 0.9 mm
- the distance between the intermediate electrode 16 and the anode electrode 17: 0.9 mm
- the voltage of the first electrode 11: 0 V
- the voltage of the second electrode 12 and the fourth electrode 14: 500 V
- the voltage of the third electrode 13 and the fifth electrode 15: 6 KV to 8 KV
- the voltage of the sixth electrode (intermediate electrode) 16: 12 KV to 20 KV
- the voltage of the seventh electrode (anode electrode) 17: 27 KV Then, as shown in FIG. 6, such electron gun 19 is disposed in the neck portion of a cathode-ray tube body 32 formed of a glass bulb and the electron beams $B_R$, $B_G$, $B_B$ are converged by the electron gun 19 to form a spot on a phosphor screen 33. A color cathode-ray tube 34 is thus constructed. Reference numeral 35 depicts a deflection yoke.

Figure 7:
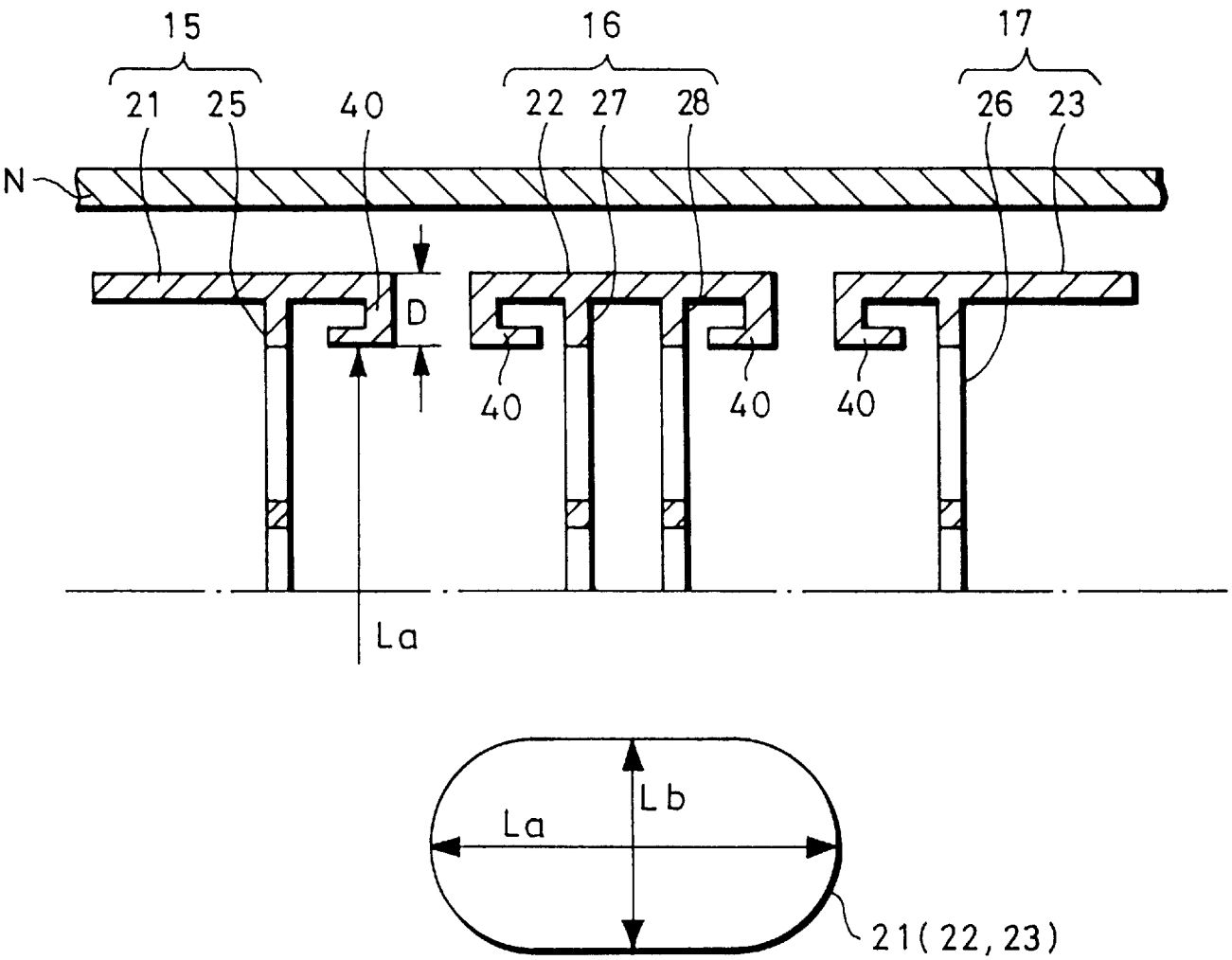
FIG. 7 is a cross-sectional view showing a main portion of a concrete example of the group of electrodes forming the main electron lens according to the present invention.

The cylindrical bodies 21, 22, 23 constituting the focusing electrode 15, the intermediate electrode 16 and the anode electrode 17 of the present example are each formed as a drawing press part having an elliptical burring portion of which major axis diameter is La and minor axis diameter is Lb, as shown in FIG. 7. The electric field correcting electrode plates 25, 26, 27, 28 are each formed of a flat plate press part.

Figure 8:
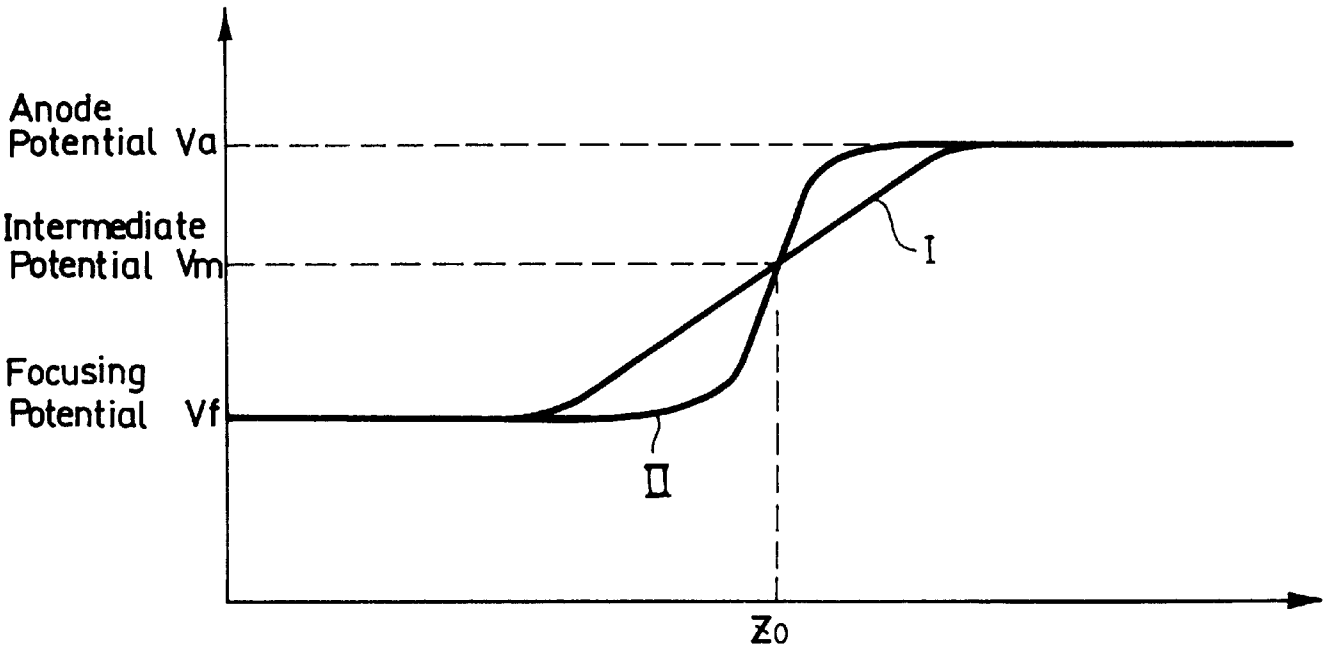
FIG. 8 is a potential distribution diagram on the axis of the main electron lens to which reference is made for explaining the present invention.

Two sheets of electric field correcting electrode plates 27, 28 constituting a part of the intermediate electrode 16 are disposed at a position deviated from a position $Z_0$ on the Z axis corresponding to the intermediate potential Vm in the axial potential distribution of FIG. 8, i.e., the axial potential distribution (I) according to the present embodiment which is decided by the focusing potential Vf of the focusing electrode 15, the intermediate potential Vm of the intermediate electrode 16 and the anode potential Va of the anode electrode 17.

According to the above embodiment, the intermediate electrode 16 maintained to have the potential Vm set in a range between the focusing potential Vf and the anode potential Va, is disposed between the focusing electrode 15 and the anode electrode 17. Therefore, the potential distribution (I) along the Z-axis between the focusing electrode 15 and the anode electrode 17 (the present embodiment) shown in FIG. 8 can be made to have a gentle slope as compared with the aforesaid potential distribution (II) along the Z-axis of the prior art example shown in FIG. 2.

Further, the intermediate electrode 16 has the electric field correcting electrode plates 27, 28 having the electron beam penetrating apertures 27*a* to 27*c* and 28*a* to 28*c* disposed at the position deviated from the position $Z_0$ on the axis corresponding to the intermediate potential Vm. Therefore, the electric field sinks into the electron beam penetrating apertures 27*a* to 27*c* and 28*a* to 28*c* of the electric field correcting electrode plates 27, 28 of the intermediate electrode 16, and hence a lens capable of controlling the shape of beam and convergence thereof is newly generated. Thus, correcting sensitivity of the electric field is improved so that it becomes possible to increase freedom in designing the electron gun so as to satisfy both the requirements for keeping a beam shape and convergence optimally. Therefore, a nearly ideal electron gun can be manufactured.

Figure 1:
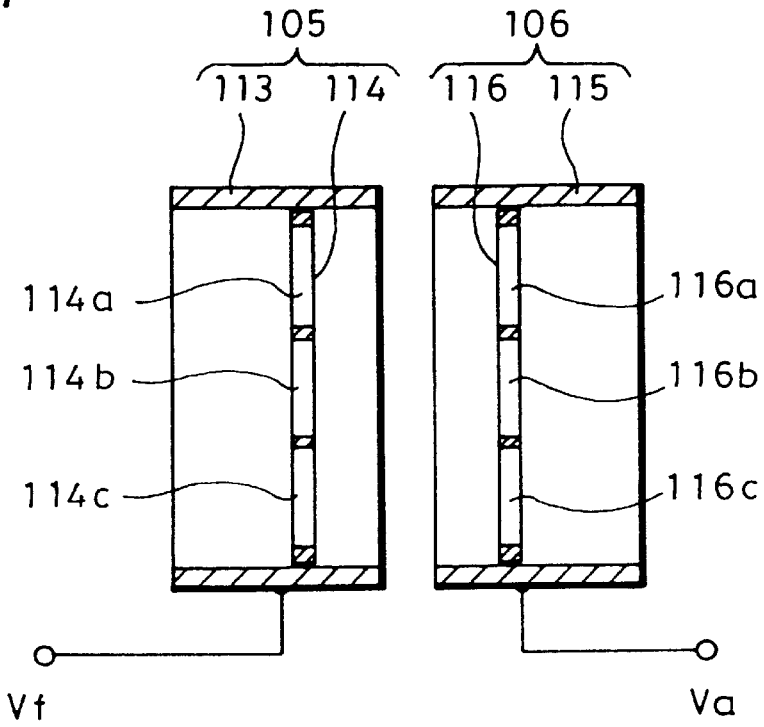
FIG. 1 is a diagram showing an example of a conventional arrangement of a group of electrodes forming a main electron lens.
Figure 2:
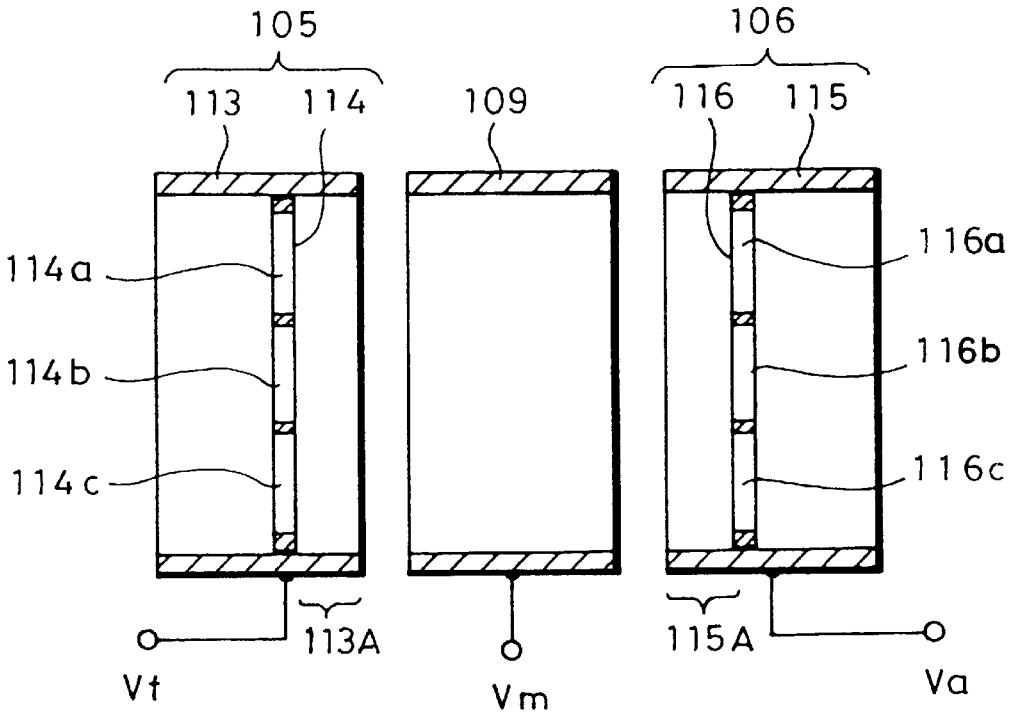
FIG. 2 is a diagram showing another example of the conventional arrangement of the group of electrodes forming the main electron lens.

That is, in the example of the above-introduced FIG. 2, when the electron gun is designed, three solutions, i.e., the beam spot shape, the beam spot size and the beam convergence are determined in association with five parameters, i.e., the correcting electrode plate 114 constituting the focusing electrode 105, the cylindrical portion 113A opposing the intermediate electrode 109 also constituting the focusing electrode 105, the intermediate electrode 109, the correcting electrode plate 116 constituting the anode electrode 106 and the cylindrical portion 115A opposing the intermediate electrode 109 also constituting the anode electrode 106.

Conversely, in the aforesaid embodiment of FIG. 3, upon designing the electron gun, the above three solutions can be obtained optimally by eight parameters, i.e., the electric field correcting electrode plate 25 constituting the focusing electrode 15, the cylindrical portion 15A of the focusing electrode 15 opposing the intermediate electrode 16, the first electric field correcting electrode plate 27 constituting the intermediate electrode 16, the second electric field correcting electrode wire 28, the cylindrical portion 16A of the intermediate electrode 16 opposing the focusing electrode 15, the cylindrical portion 16B of the intermediate electrode 16 opposing the anode electrode 17, the electric field correcting electrode plate 26 constituting the anode electrode 17 and the cylindrical portion 17A of the anode electrode 17 opposing the intermediate electrode 16. Thus, the freedom in designing the main electron lens is increased in case of the present embodiment.

In FIG. 3, the electric field correcting electrode plates 25, 26, 27, 28 are disposed at positions recessed from the openings of the cylindrical bodies 21, 23, 22, respectively. Therefore, in addition to the large lenses formed between the focusing electrode 15 and the intermediate electrode 16 and between the intermediate electrode 16 and the anode electrode 17, a lens capable of controlling the beam shape, the beam spot size and the beam convergence is formed by the electron beam penetrating apertures of the respective electric field correcting electrode plates 25, 26, 27, 28.

The correction sensitivity of the electric field is improved by the electric field correcting electrode plates 27, 28 of the intermediate electrode 16, with the result that the intermediate electrode 16 is permitted to be further elongated. For example, the intermediate electrode 16 can be made to have a length of 8 mm or more. Moreover, the main electron lens can be made to have a gentler slope in the axial potential distribution as compared with a prior art.

In this way, the aperture of the main electron lens is further increased and the spherical aberration coefficient of the lens is decreased as compared with a case in which the aperture of the lens is enlarged according to the conventionally proposed method. Therefore, the beam spot diameter converged on the phosphor screen is reduced and high resolution can be achieved over the whole area of the screen.

On the other hand, when the intermediate electrode 16 is elongated, the intermediate voltage Vm and the focusing voltage Vf are changed. As a result, the difference between the focusing voltage Vf and the voltage Vm of the intermediate electrode and the difference between the voltage Vm of the intermediate electrode and the anode voltage Va are decreased. For this reason, the distance between the respective electrodes can be shortened, with the result that the influence of the electric field from the neck wall can be decreased. Therefore, as shown in FIG. 7, a distance D between the side wall of the electrode opposing a neck N and a burring portion of the lens can be decreased. Which fact permits the focusing electrode 15, the intermediate electrode 16 and the anode electrode 17 to have a large size for the major axis La of the elliptical shape and the diameter of the lens to be enlarged further.

Figure 9:
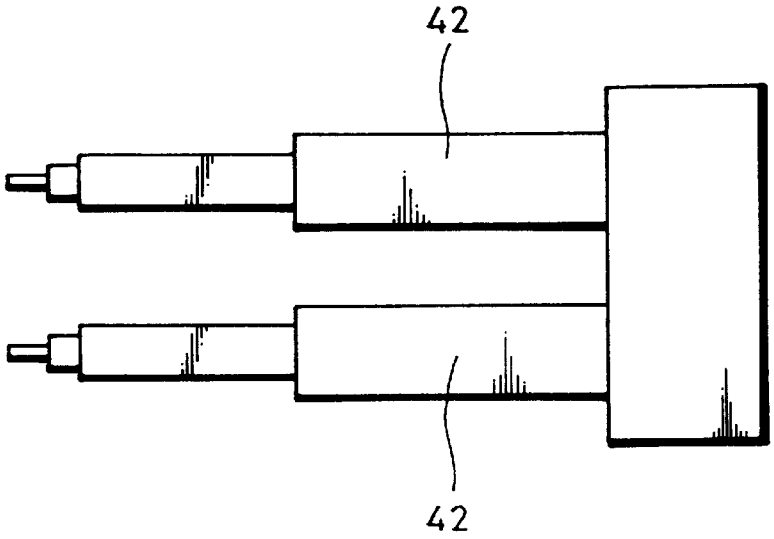
FIG. 9 is a constructional diagram showing an example of an inner core pin useful for assembling the electron gun.

Further, the electric field correcting electrode plates 25, 27, 28 and 26 are provided in the focusing electrode 15, the intermediate electrode 16 and the anode electrode 17. Therefore, when a pair of inner core pins 42 shown in FIG. 9 are inserted into the corresponding electron beam penetrating apertures of the electric field correcting electrode plates 25, 27, 28 and 26, upon assembling the electron gun, the group of the electrodes of the main electron lens portion can be assembled with high accuracy.

Incidentally, comparison between the dimensional accuracy of an elliptical burring portion 40 formed by drawing press and the dimensional accuracy of the beam penetrating aperture of the electric field correcting electrode plate formed of a flat plate press part reveals that the latter is better. For example, the former has a tolerance of about 30 $\mu$m while the latter has a tolerance of about 15 $\mu$m, which is half the former. Therefore, if these electric field correcting electrodes are positioned and assembled by using the pair of inner core pin inserted into the beam penetrating apertures of high accuracy, then the electron gun can be assembled with higher accuracy.

Figure 10:
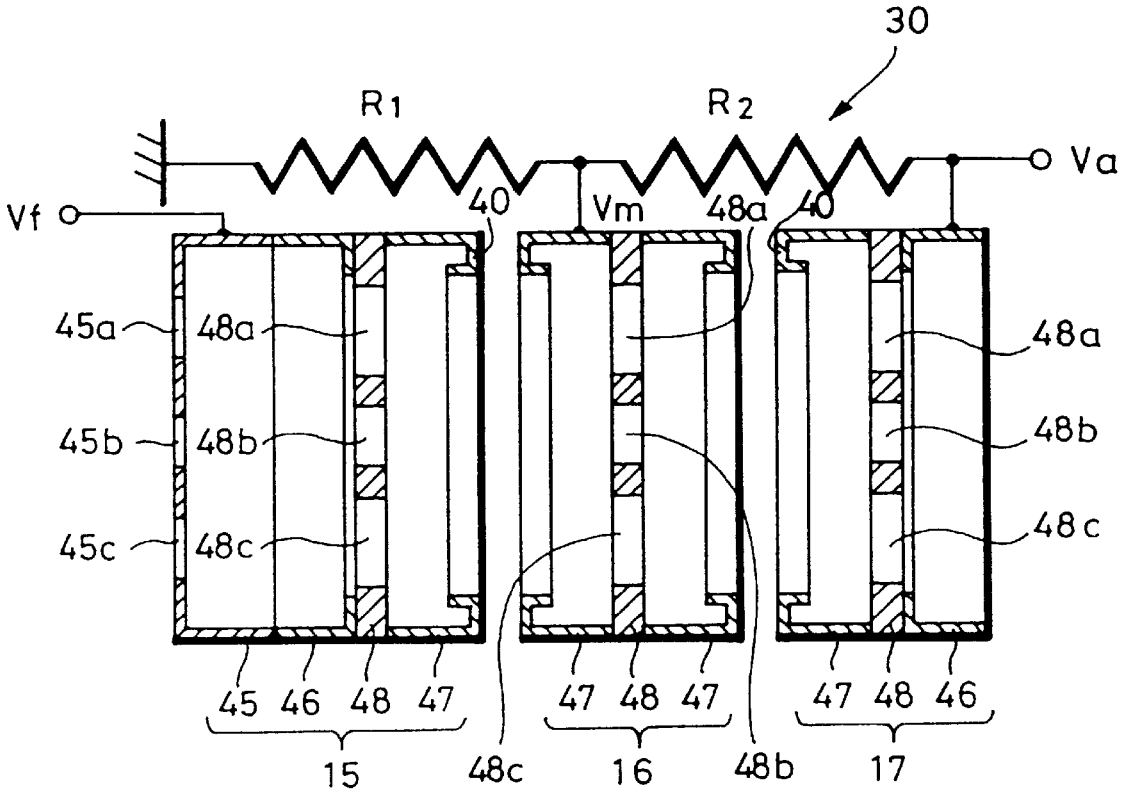
FIG. 10 is a constructional diagram showing another example of the group of electrodes of the electron gun forming the main electron lens according to the present invention.
Figure 11A:
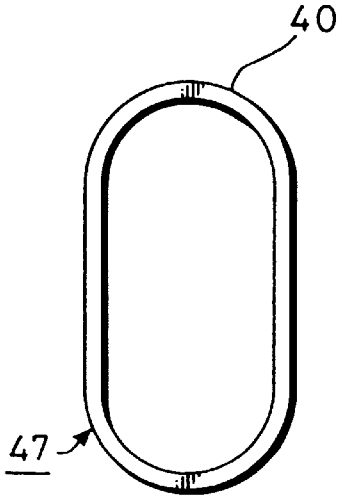
FIGS. 11A and 11B are a front view showing one example of a shape of a cylindrical body of the electrode forming the main electron lens of FIG. 10, and a front view showing one example of an electric field correcting electrode plate of FIG. 10, respectively.
Figure 11B:
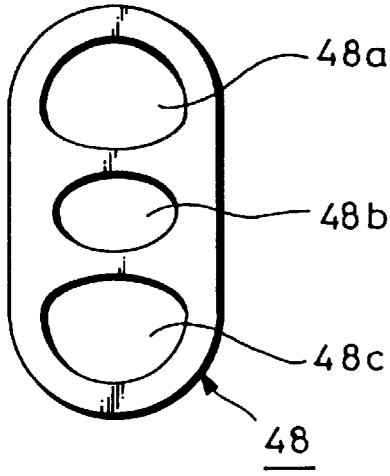

FIG. 10 and FIGS. 11A and 11B show another embodiment of the present invention. In this example, the aforesaid intermediate electrode 16 of FIG. 3 has only one electric field correcting electrode plate provided.

In this example, similarly to the aforesaid example, between the focusing electrode (e.g., the fifth electrode) 15 applied with the focusing voltage Vf and the anode electrode (e.g., the seventh electrode) 17 applied with the anode voltage Va, there is disposed the intermediate electrode (e.g., the sixth electrode) 16 applied with the intermediate voltage Vm which is lower than the anode voltage and higher than the focusing voltage.

The focusing electrode 15 is comprised of a front stage lens forming part 45 formed of a cylindrical body having three electron beam penetrating apertures 45*a*, 45*b*, 45*c* at the end face thereof, a drift space part 46 formed of a cylindrical body, an electric field correcting electrode plate 48 formed of a flat plate press part having three electron beam penetrating apertures 48*a*, 48*b*, 48*c*, and a drawing press part 47 formed of a cylindrical body having one oval burring portion 40. These respective parts 45, 46, 48, 47 are made into a unitary body by welding or the like.

The anode electrode 17 is comprised of a drift space part 46 formed of a cylindrical body, an electric field correcting electrode plate 48 formed of a flat plate press part having three electron beam penetrating apertures 48*a*, 48*b*, 48*c*, and a drawing press part 47 formed of a cylindrical body having one oval burring portion 40. These respective parts 46, 48, 47 are made into a unitary body by welding or the like.

The intermediate electrode 16 is comprised of an electric field correcting electrode plate 48 formed of a flat plate press part having three electron beam penetrating apertures 48*a*, 48*b*, 48*c* at the center thereof, and drawing press parts 47, 47, each being formed of a cylindrical body having an elliptical burring portion 40, sandwiching the electric field correcting electrode plate 48 from both the sides thereof. These respective parts 47, 48, 47 are made into a unitary body by welding or the like.

The cylindrical parts forming the focusing electrode 15, the intermediate electrode 16 and the anode electrode 17, particularly, their burring portions 40 are formed into an elliptical shape as shown in FIG. 11A, similarly to the case of FIG. 4A. Further, the beam penetrating apertures 48*a*, 48*b*, 48*c* of each of the electric field correcting electrode plates 48 are formed to be a shape shown in FIG. 11B. The beam penetrating apertures 48*a* to 48*c* can take various shapes, similarly to the aforesaid example.

Thus, the main electron lens is formed by the above-arranged focusing electrode 15, the intermediate electrode 16 and the anode electrode 17.

Similarly to the aforesaid embodiment, parts concerning the main electron lens are the flat plate press parts having the three electron beam penetrating apertures, or the electric field correcting electrode plates 48 and the drawing press parts 47 each having one elliptical burring portion 40.

Similarly to the above-described embodiment, the electric field correcting electrode plate 48 of the intermediate electrode 16 may be disposed at a position deviated from the position $Z_0$ on the axis corresponding to the intermediate potential Vm on the axis of the potential distribution which is decided by the focusing potential Vf, intermediate potential Vm and the anode potential Va.

The arrangement of the other portions are similar to those of the aforesaid embodiment. Thus, corresponding parts are attached with the same reference numerals and they will not be explained.

The focusing electrode 15 and the anode electrode 17 may be constructed such that the drift space part 46 and the drawing press part 47 having one elliptical burring portion 40 are made into a unitary part and the electric field correcting electrode portion 48 formed of a flat plate press part having the three electron beam penetrating apertures 48*a* to 48*c* is provided therein.

The intermediate electrode 16 may be constructed such that the two drawing press parts 47, 47 are formed into a unitary part and the electric field correcting electrode plate 48 formed of a flat plate press part having the three electron beam penetrating apertures 48*a* to 48*c* is provided therein.

The focusing electrode 15, the intermediate electrode 16 and the anode electrode 17 employ the same electric field correcting electrode plate 48 of a flat plate press part having the three electron beam penetrating apertures 48*a* to 48*c* and the drawing press part 47 having one elliptical burring portion 40. However, the focusing electrode 15, the intermediate electrode 16 and the anode electrode 17 may employ parts differing in their dimension, shape and so on.

Also in the embodiment of FIG. 10, similarly to the above embodiment, the intermediate electrode 16 of the cylindrical body is provided with one electric field correcting electrode plate 48 having the three electron beam penetrating apertures 48*a* to 48*c* and is provided between the focusing electrode 15 and the anode electrode 17. Therefore, the intermediate electrode 16 can be elongated more, the slope of the potential distribution on the axis of the main electron lens can be made gentle, and the electric field can be expanded to thereby enlarge the aperture of the main electron lens. Accordingly, the spherical aberration coefficient is decreased, the beam spot can be reduced in its diameter, and resolution is improved.

Also in the embodiment, the intermediate electrode 16 is provided with one electric field correcting electrode plate 48 having the beam penetrating apertures 48*a* to 48*b*. Therefore, the electric field sinks into the beam penetrating apertures 48*a* to 48*c* with the result that a new lens is generated, the correcting sensitivity of the electric field is improved and design freedom for satisfying the requirements for keeping the beam shape, the beam size and the beam convergence optimally is improved.

Specifically, the above-described three solutions on the electron beam can be obtained optimally by seven parameters, i.e., the electric field correcting electrode plates 48 made of a flat plate press part constituting the focusing electrode 15, the drawing press part 47 having the elliptical burring portion opposing the intermediate electrode 16, the drawing press parts 47 having the oval burring portion constituting the intermediate electrode 16 and opposing the focusing electrode 15, the electric field correcting electrode plate 48 made of a flat plate press part, the drawing press part 47 having the elliptical burring portion and opposing the anode electrode 17, the drawing press part 47 having the elliptical burring portion, constituting the anode electrode 17 and opposing the intermediate electrode 16, and the electric field correcting electrode plate 48 of a flat plate press part. Accordingly, the freedom in designing the main electron lens can be further increased as compared with the prior art example of FIG. 2.

Further, since the intermediate electrode 16 can be elongated further, the difference in voltage between the focusing electrode 15 and the intermediate electrode 16 and the difference in voltage between the intermediate electrode 16 and the anode electrode 17 are decreased. For this reason, the distance between the respective electrodes can be shortened, and the electron lens will be less influenced from the electric field from the neck wall. Therefore, the distance D of the burring portion 40 can be decreased, and hence the major axis diameter La of the elliptical cylindrical body can be enlarged to further enlarge the diameter of the lens.

Further, when the electron gun is assembled, the pair of inner core pins 42 shown in FIG. 9 are inserted into the corresponding electron beam penetrating apertures of the respective electric field correcting electrode plates 48 of the focusing electrode 15, the intermediate electrode 16 and the anode electrode 17 to determine the relative positions of the focusing electrode 15, the intermediate electrode 16 and the anode electrode 17. In this manner, similarly to the aforesaid embodiment, the group of the electrodes of the main electron lens portion can be assembled with high accuracy.

While there have been explained the embodiments in which the single intermediate electrode 16 is disposed between the focusing electrode 15 and the anode electrode 17, a plurality of, or two or more intermediate electrodes 16 may be disposed therebetween upon designing the main electron lens. If the number of the intermediate electrodes 16 is increased, the slope of the potential distribution becomes gentle correspondingly.

While in the above respective embodiments the electric field correcting electrode plates 25, 27, 28, 26 (or 48) provided in the focusing electrode 15, the anode electrode 17 and the intermediate electrode 16 are each disposed at a position recessed inwardly from the opening of the cylindrical body, a predetermined one of the electric field correcting electrode plates may be disposed at the end portion of the cylindrical body depending on a solution in designing the main electron lens. Therefore, it should be understood in the present invention that at least one of the electric field correcting electrode plates is disposed at a position recessed from the opening of the cylindrical body.

Figure 12:
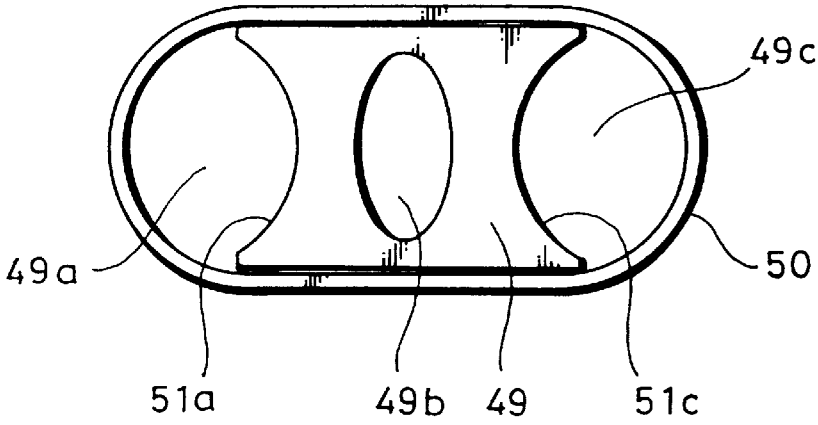
FIG. 12 is a constructional diagram showing another example of the electric field correcting electrode plate.

While in the above respective embodiments the electron beam penetrating portions of the electric field correcting electrode plates 25, 27, 28, 26 (or 48) are each formed of a penetrating aperture, other arrangement may be employed such that, as for example shown in FIG. 12, one penetrating aperture 49*b* is formed at the center of an electric field correcting electrode plate 49, and notch portions 51*a*, 51*c* of a circular shape or an elliptical shape are formed at both the sides thereof and that the electron beam penetrating portions are formed of penetrating apertures 49*a*, 49*c* which are surrounded by the notch portions 51*a*, 51*c* and the arc shaped side walls of a cylindrical body 50.

While in the above embodiment shown in FIG. 3, in the intermediate electrode 16, the two electric field correcting electrode plates 27, 28 are disposed at positions deviated from the position $Z_0$ on the axis corresponding to the intermediate potential Vm, other arrangement may be employed such that the two sheets of electric field correcting electrode plates are replaced with one sheet of an electric field correcting electrode plate of which thickness is equal to the distance between that two electric field correcting electrode plates. In this case, effects similar to that in a case where the two electric field correcting electrode plates are disposed can be expected.

On the other hand, as set forth above, in order to apply an intermediate voltage Vm, e.g., about a voltage of 12 to 20 KV, which is a voltage between the anode voltage Va and the focusing voltage Vf, to the intermediate electrode 16, a so-called incorporated dividing resistor 30 is utilized for dividing a voltage.

Figure 14:
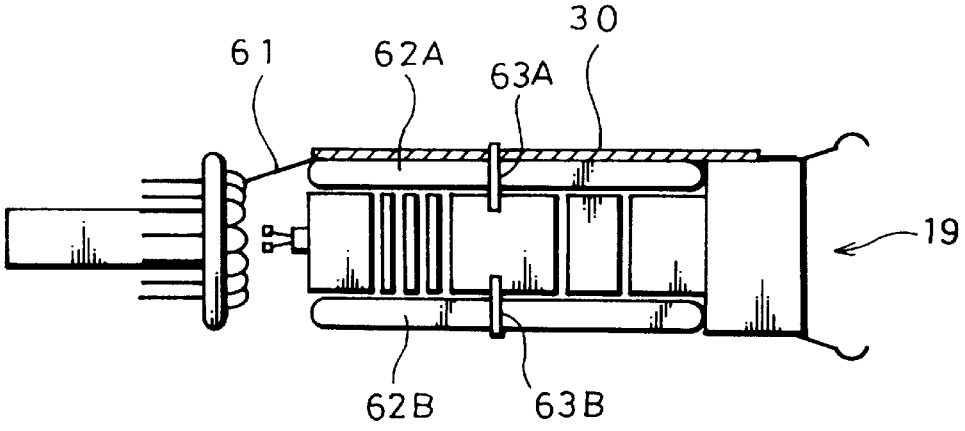
FIG. 14 is a constructional diagram showing the example of the electron gun of FIG. 5.

As described with reference to FIG. 5, a terminal (first terminal) $t_1$ at one end side of the incorporated dividing resistor 30 is connected to the anode electrode 17 (in the figure, the shield cup 18 unitarily formed with the anode electrode 17) so as to be applied with the anode voltage Va. A terminal (second terminal) $t_2$ at the other end side thereof is grounded (i.e., connected to a stem pin), a third terminal $t_3$ at which the intermediate voltage is obtained is connected to the intermediate electrode 16. In this arrangement, as shown in FIG. 14, the incorporated dividing resistor 30 necessarily becomes long to extend from the vicinity of the anode electrode 17 (including shield cup 18) to the vicinity of a stem pin 61. The incorporated dividing resistor 30 may be fixed on one of a bead glass body 62A.

In order to stabilize the potential distribution within the neck portion and suppress discharging, a metal vapor-deposited film is provided on the inner wall of the neck portion. This metal vapor-deposited film is formed in such a manner that metal bodies (so-called metal wires) 63 [63A, 63B] are wound around bead glass bodies 62 [62A, 62B] disposed above and below the electron gun and then the metal bodies 63 are heated by applying high frequency wave from the outer periphery of the neck portion to be evaporated to form the metal vapor-deposited film on the inner wall of the neck portion. In this case, one of the metal body 63A is wound around the bead glass body 62A including the outer periphery of the incorporated dividing resistor 30 while the other metal body 63B is wound around the bead glass body 62B only.

Figure 19:
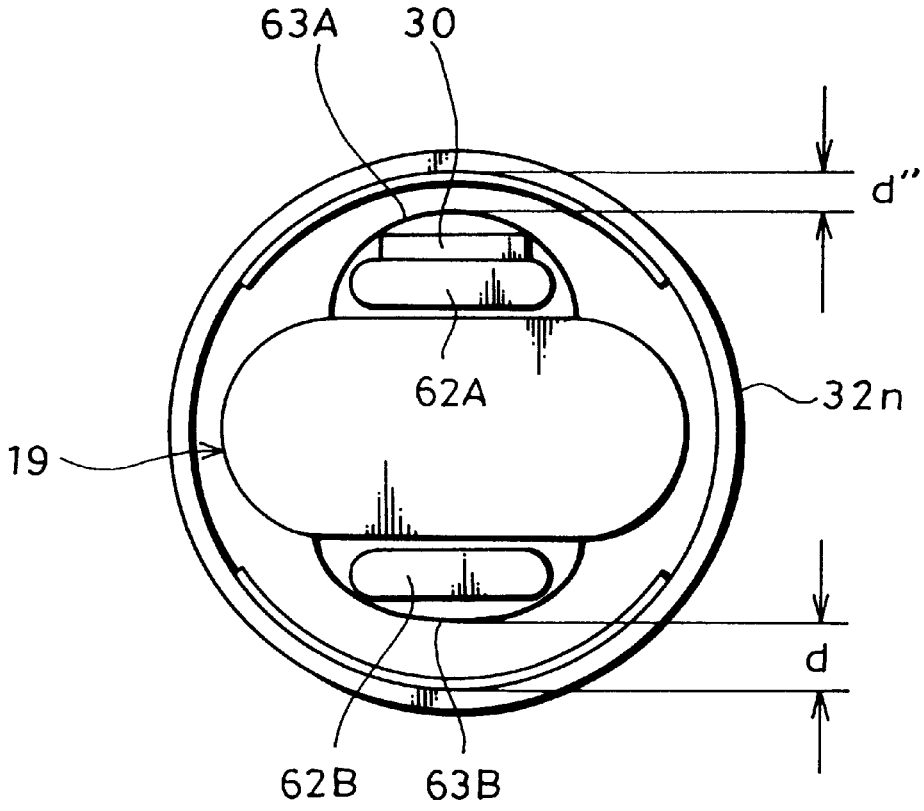
FIG. 19 is a cross-sectional view of a neck portion provided with the electron gun of FIG. 14.

Since one metal body 63A is wound around both of the bead glass body 62A and the incorporated dividing resistor 30 while the other metal body 63B is wound around only the bead glass body 62, metal bodies 63A, 63B are disposed asymmetrically in terms of up-and-down direction (see FIG. 19). More specifically, the metal body 63A on the side of the incorporated dividing resistor 30 is too close to the inner wall of the neck portion, or in an excessive case, the incorporated dividing resistor 30 is brought to contact to the inner wall of the neck portion as compared with the case of the metal body 63B provided on the opposite side. Therefore, if the metal bodies are tried to be heated sufficiently, unbalance in heating is caused, leading a risk that a crack is caused at the inner wall of the neck portion. For this reason, it is necessary to set a modest heating condition, which makes it difficult to form a vapor-deposited film evenly on the sides on which the upper and lower metal bodies 63A, 63B are provided respectively. Therefore, it is difficult to maintain the voltage withstand characteristic satisfactorily. Further, since the metal body 63A on the side of the incorporated dividing resistor 30 comes close to the inner wall of the neck portion, the electron gun has to have a small diameter to secure clearance.

Figure 13:
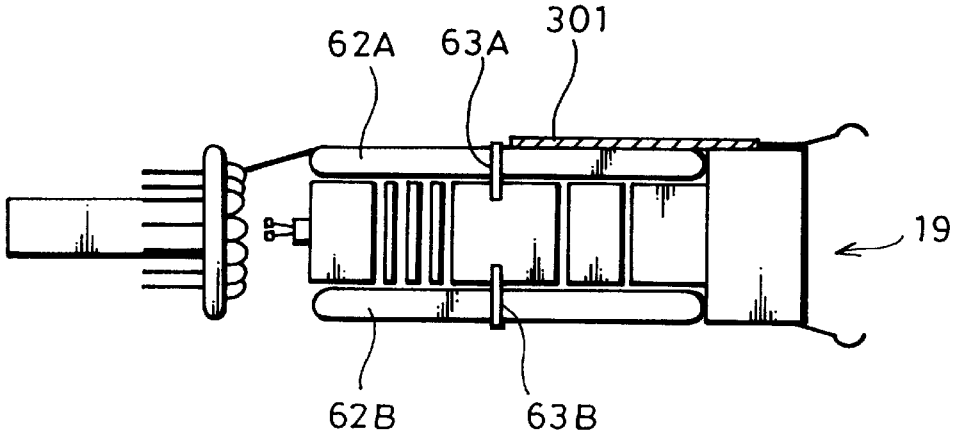
FIG. 13 is a constructional diagram showing another example of the electron gun according to the present invention.
Figure 15:
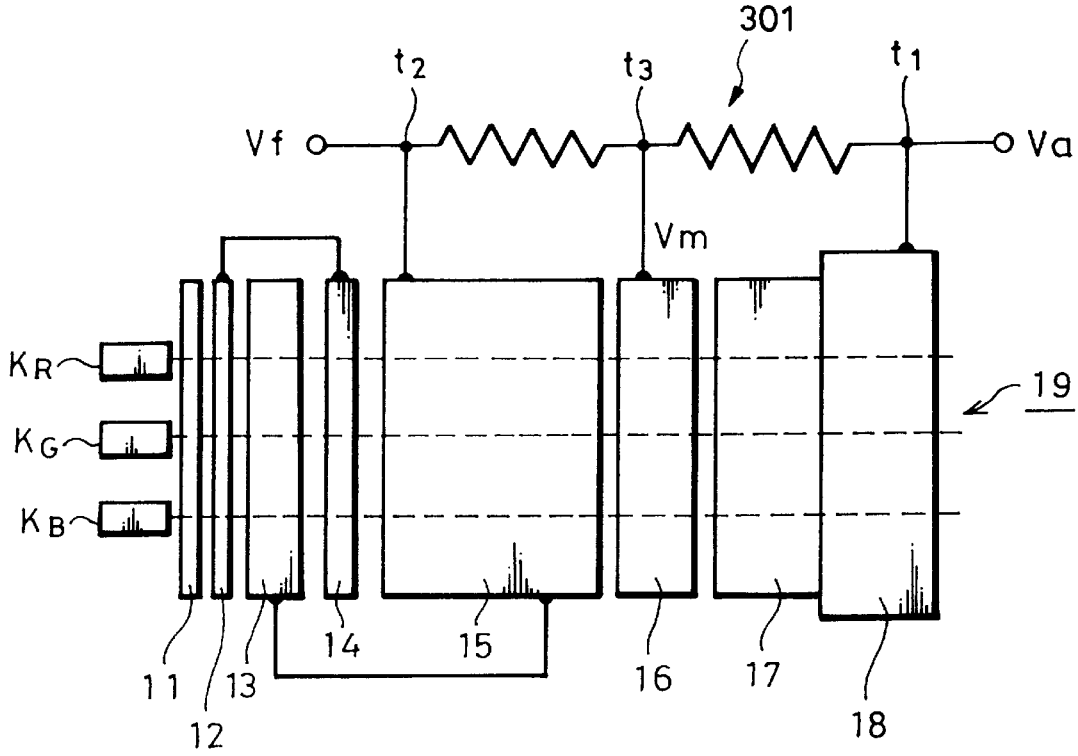
FIG. 15 is a constructional diagram of a main portion of the electron gun of FIG. 13.
Figure 16:
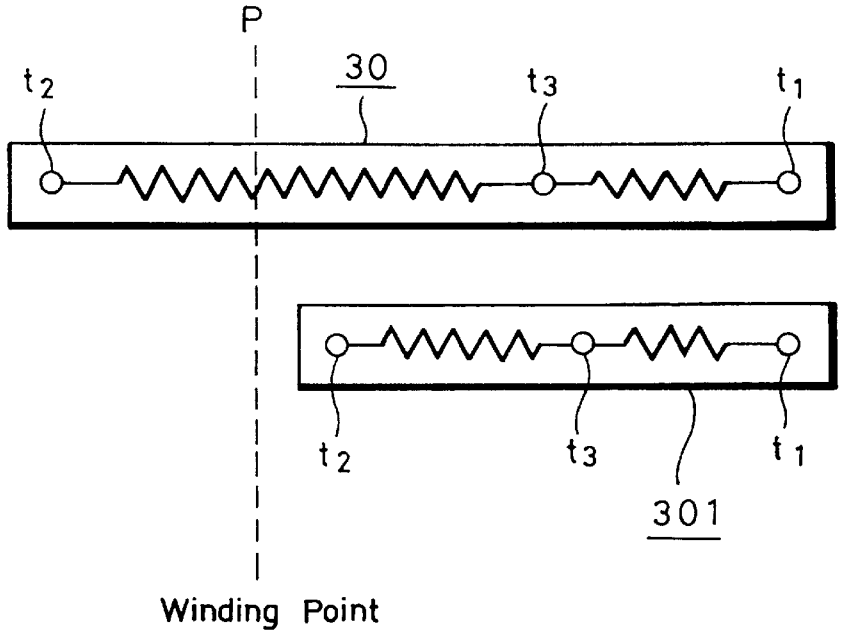
FIG. 16 is a schematic constructional diagram showing examples of incorporated dividing resistors employed in the electron gun of FIG. 13.

FIGS. 13, 15 and 16 show an embodiment of the present invention in which the above drawback is eliminated.

In the embodiment of FIG. 13 and FIG. 15, similarly to the above-described arrangement of FIG. 5, the electron gun 19 is equipped with the first electrode 11 to fourth electrode 14, and the focusing electrode 15, the intermediate electrode 16 and the anode electrode 17 forming the main electron lens (main focusing lens). This electron gun 19 is provided with an incorporated dividing resistor 301 of which whole length is short. A terminal (first terminal) $t_1$ of the incorporated dividing resistor 301 at its one end side is connected to the anode electrode 17 unitarily formed with the shield cup 18 to which the anode voltage Va is applied while a terminal (second terminal) $t_2$ of the incorporated dividing resistor 301 at its other end side is connected to the focusing electrode 15 to which the focusing voltage Vf is applied. A third terminal $t_3$ between the first terminal $t_1$ and the second terminal $t_2$ is connected to the intermediate electrode 16, whereby the intermediate voltage Vm obtained at the third terminal $t_3$ is supplied to the intermediate electrode 16.

According to the arrangement of the above embodiment, the second terminal $t_2$ of the incorporated dividing resistor 301 is connected to the electrode which is maintained to have a constant voltage lower than the anode voltage under the electron gun active state. Therefore, the resistor body can be made short and at the same time the whole length of the incorporated dividing resistor 301 can also be made short. Specifically, the first terminal $t_1$ and the second terminal $t_2$ of the incorporated dividing resistor 301 at its both ends are connected to the anode electrode 17 and the focusing electrode 15, respectively. Therefore, the whole length of the incorporated dividing resistor 301 can be made short.

Therefore, the metal body 63A on the side of the incorporated dividing resistor 301 is wound around only the bead glass body 62A at a position apart from the incorporated dividing resistor 301, as shown in FIG. 13 (see relation between a winding position P of the metal body 63A and the position of the incorporated dividing resistor 301 shown in FIG. 16). That is, both of the metal bodies 63A and 63B are wound symmetrically around the upper bead glass body 62A and the lower bead glass body 62B. Accordingly, a proper heating condition will be effected on the metal bodies 63A, 63B, causing proper evaporation, with the result that an even evaporation film can be formed on the inner wall of the neck portion. Thus, a satisfactory voltage withstand characteristic can be maintained.

Moreover, since both the metal bodies 63A, 63B are wound under the same condition, the electron gun 19 can be made to have a lens of a large diameter.

Furthermore, since the whole length of the incorporated dividing resistor 301 is shortened, the incorporated dividing resistor 301 can be manufactured inexpensively.

The embodiment shown in FIG. 13 and FIG. 15 is advantageous for securing a satisfactory voltage withstand characteristic and enlarging the diameter of the electron gun. However, it is necessary to consider electric characteristic of a power supply for applying the focusing potential.

To this end, there is proposed an embodiment shown in FIGS. 17, 18, 20A, 20B and 20C in which voltage withstand characteristic is made stable, and the electron gun is made to have a large diameter without consideration on such electric characteristic of a circuit.

Figure 17:
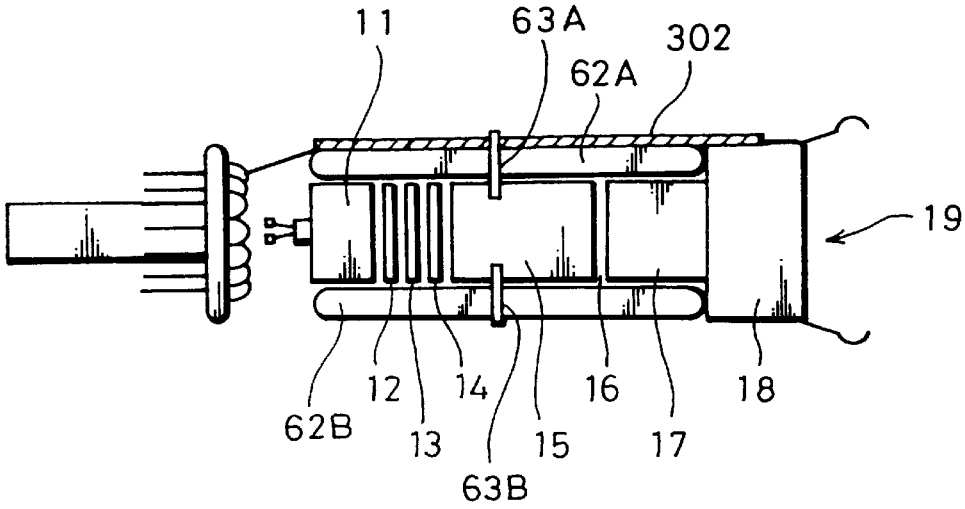
FIG. 17 is a constructional diagram showing another example of the electron gun according to the present invention.
Figure 18:
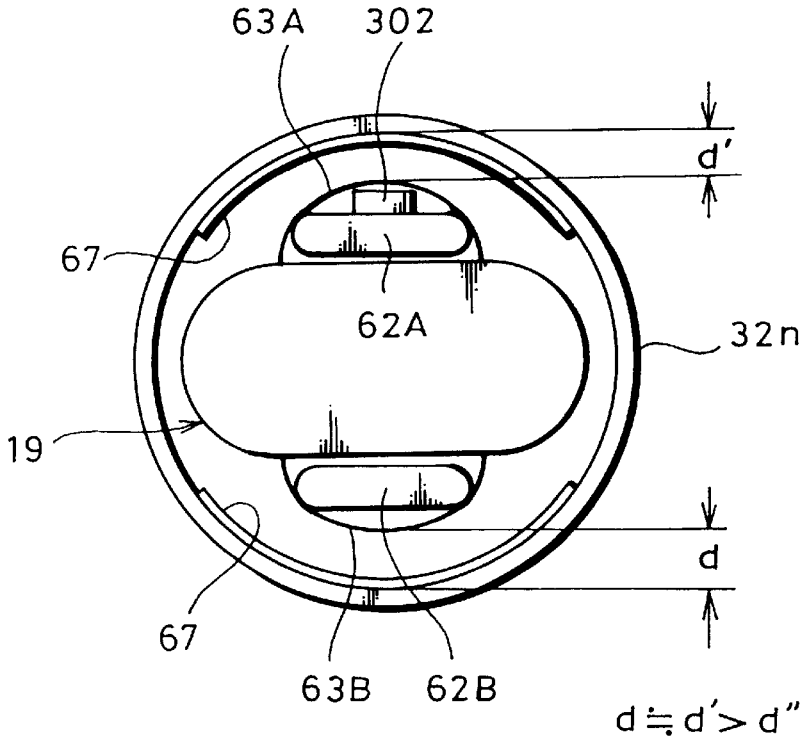
FIG. 18 is a cross-sectional view of a neck portion provided with the electron gun of FIG. 17.
Figures 20A, 20B, 20C:
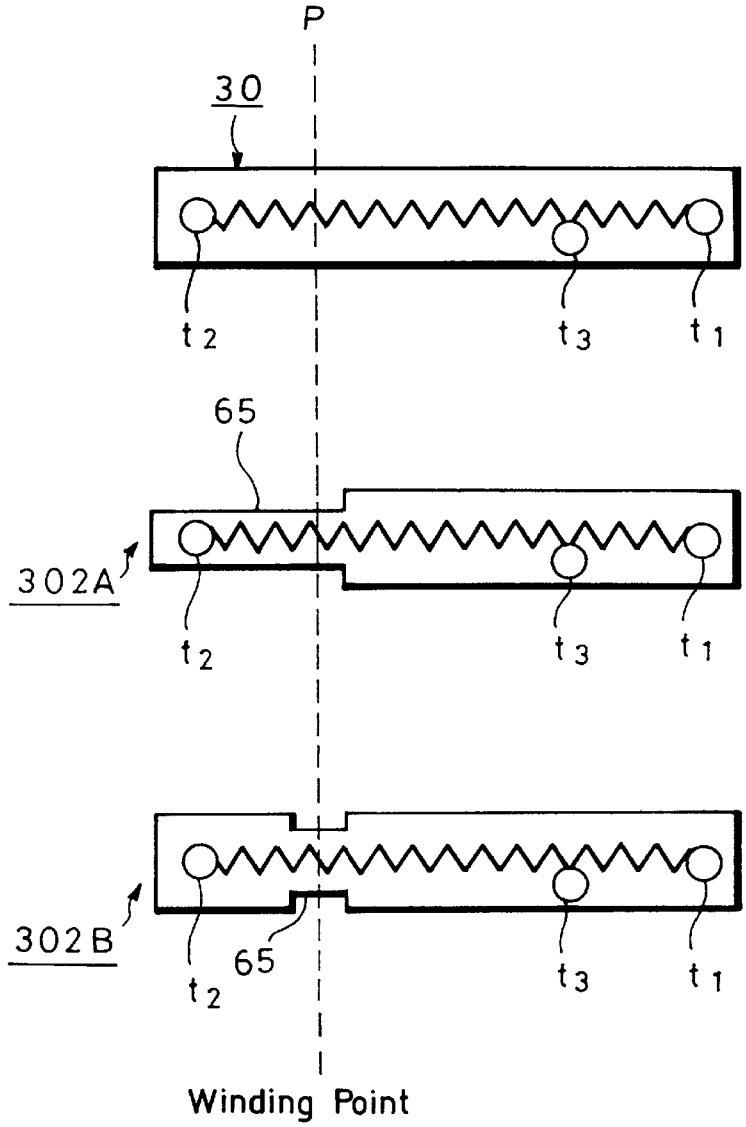
FIGS. 20A through 20C are respectively schematic constructional diagram showing incorporated dividing resistors employed in the electron gun of FIG. 17.

In the embodiment of FIGS. 17 and 18, similarly to the above-described arrangement, the electron gun 19 is equipped with the first electrode 11 to the fourth electrode 14, and the focusing electrode 15, the intermediate electrode 16 and the anode electrode 17 forming the main electron lens (main focusing lens). This electron gun 19 is provided with an incorporated dividing resistor 302 [302A or 302B] of a substrate shape having a width constricted portion 65 as shown in FIG. 20B or 20C, so that the metal body 63A is wound around the incorporated dividing resistor 302 at the width constricted portion. The terminal (first terminal) $t_1$ of the incorporated dividing resistor 302 at its one end side is connected to the anode electrode 17 to which the anode voltage is applied while the terminal (second terminal) $t_2$ of the same at its other end side is grounded (i.e., connected to the stem pin). A third terminal $t_3$ between the first terminal $t_1$ and the second terminal $t_2$ is connected to the intermediate electrode 16, whereby the intermediate voltage Vm obtained at the third terminal $t_3$ is supplied to the intermediate electrode 16. Then, the metal body 63A is wound around the incorporated dividing resistor 302 at its width constricted portion 65 including the bead glass body 62A (see FIGS. 18, 20B and 20C).

The incorporated dividing resistor 302A of FIG. 20B is formed into a substrate shape having the width constricted portion 65 which extends from a vicinity around which the metal body 63A is wound to an end portion on the second terminal $t_2$ side.

The incorporated dividing resistor 302B of FIG. 20C is formed into a substrate shape which only has the width constricted portion 65 around which the metal body 63A is wound.

The incorporated dividing resistor 30 is again shown in FIG. 20A for comparison.

According to the arrangement, the incorporated dividing resistor 302 is provided with the width constricted portion 65, and the metal body 63A is wound around the width constricted portion 65. Therefore, as shown in FIG. 18, the distance d' between the metal body 63A and the inner wall of the neck portion 32*n* on the side in which the incorporated dividing resistor 302 is provided, becomes substantially equal to the distance d between the metal body 63B and the inner wall of the neck portion on the side in which there is no incorporated dividing resistor 302 provided (d≈d'). Thus, the distances d and d' become symmetrical.

Therefore, when the metal bodies 63A, 63B are heated to make vapor deposition, separation of the metal body 63A from the inner wall of the neck portion is guaranteed, permitting sufficient heating for making vapor deposition, with the result that satisfactory voltage withstand characteristic can be obtained.

Further, a vapor-deposited film 67 can be formed on the upper side on which the incorporated dividing resistor 302 is provided and on the lower side on which the incorporated dividing resistor 302 is not provided. Thus, the voltage withstanding characteristic can be improved and the stable voltage withstanding characteristic can be obtained.

By way of example, in the case of the embodiment of FIG. 4, as shown in FIG. 19, the distance d" between the metal body 63A and the inner wall of the neck portion on the side in which the incorporated dividing resistor 30 is provided, becomes smaller than the distance d between the metal body 63B and the inner wall of the neck portion on the side in which there is no incorporated dividing resistor 302 provided (d>d"). That is, there is asymmetry between the positional relation between the upper metal body 63A and the inner wall of the neck portion and positional relation between the lower metal body 63B and the inner wall of the neck portion. However, this asymmetry is eliminated in the embodiment of FIG. 18.

Further, the electron gun of the present embodiment can be driven with the similar circuit and electric characteristic to the electron gun employing the conventional incorporated dividing resistor 30. Further, the present embodiment can solve the problem that the spacing between the metal body 63A and the inner wall of the neck portion becomes small. As a result, the electron gun 19 can be made to have a large diameter.

According to the present invention, the intermediate electrode disposed between the focusing electrode and the anode electrode can be elongated, and the slope of the potential distribution on the axis of the main electron lens can be made gentler. Therefore, the aperture of the main electron lens can be enlarged, the spherical aberration coefficient of the lens can be decreased, the diameter of the beam spot converged on the phosphor screen can be reduced and high resolution can be achieved over the whole area of the screen.

According to the present invention, the cylindrical intermediate electrode is provided with the electric field correcting electrode plate having the beam penetrating portion. Therefore, the number of parameters for controlling the shape of the beam, the size of the beam and convergence of the beam is increased, freedom in designing the main electron lens is increased, and the electron gun can be designed more optimally.

According to the present invention, each of the focusing electrode, the intermediate electrode and the anode electrode is provided with the electric field correcting electrode plate having an electron beam penetrating portion. Therefore, an inner core pin can be introduced for assembling the electron gun in a manner such that the inner core pin is inserted into the electron beam penetrating aperture to determine the positional relationship among the electrodes. Accordingly, the group of electrodes contributing to formation of the main electron lens can be assembled with higher accuracy.

According to the present invention, the first terminal on one end side of the incorporated dividing resistor is connected to the anode electrode to which the anode voltage is applied while the second terminal, i.e., the terminal on the other end side of the incorporated dividing resistor is connected to the focusing electrode to which the focusing electrode is applied, and the third terminal provided between the first terminal and the second terminal is connected to the intermediate electrode to apply thereto the intermediate voltage between the anode voltage and the focusing voltage. Therefore, the whole length of the incorporated dividing resistor can be made short.

Therefore, the metal bodies, which are provided at upper and lower portions of the electron gun for forming vapor-deposited metal film in order for stabilizing the potential distribution within the neck portion and suppressing discharge, can be wound around the electron gun in a symmetrical fashion. Since it can be expected that the vapor-deposited films are formed equivalently on the upper and lower portions of the electron gun, the color cathode-ray tube will have a stable characteristic.

At the same time, since the metal bodies can be disposed away from the inner wall of the neck portion, i.e., an ample spacing can be secured between the metal body and the inner wall of the neck portion, it is possible to design the electron gun to have a lens of a large diameter. Furthermore, since the incorporated dividing resistor can be made short, the incorporated dividing resistor can be made inexpensively.

According to the third aspect of the present invention, the incorporated dividing resistor for supplying the intermediate voltage to the intermediate electrode is made to have the width constricted portion, and the metal body is wound around the incorporated dividing resistor at the width constricted portion. Therefore, the distance between the metal body and the inner wall of the neck portion can be kept large, and hence it is possible to prevent the metal body from being contacted to the inner wall of the neck portion upon heating the metal body to effect vapor deposition. Accordingly, the metal body can be sufficiently heated to make satisfactory vapor deposition, which makes it possible to obtain satisfactory voltage withstand characteristic.

Further, the vapor-deposited films can be formed on both the sides with equivalence between one side on which the incorporated dividing resistor is provided and the other side on which the incorporated dividing resistor is not provided. Therefore, stable voltage withstand characteristic can be obtained.

Furthermore, according to third aspect of the present invention, it is possible to drive the electron gun with a circuit having an electric characteristic similar to that of a conventional electron gun. Therefore, when an arrangement is made to obtain the above effects, it is unnecessary to consider the electric characteristic of the circuit, and hence the electron gun according to the present invention can be handled in the same manner as that when the conventional electron gun is handled.

In addition, similarly to the second aspect of the present invention, the metal body can be provided distant from the inner wall of the neck portion, i.e., spacing between the metal body and the inner wall of the neck portion can be secured. Therefore, the electron gun is made to have a lens of a large diameter.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A color cathode-ray tube comprising:

a focusing electrode applied with a focusing voltage;

an anode electrode applied with an anode voltage; and an intermediate electrode disposed between said focusing electrode and said anode electrode and provided with an intermediate voltage which is higher than said focusing voltage and lower than said anode voltage, said intermediate electrode being maintained at a potential by said intermediate voltage through an incorporated dividing resistor, wherein each of said focusing electrode, said anode electrode and said intermediate electrode is formed of a cylindrical body of an elliptical cross-section closed by an electric field correcting electrode plate having three electrode beam penetrating portions bored therethrough so as to be arrayed in an in-line fashion.

2. The color cathode-ray tube according to claim 1, wherein at least one electric field correcting electrode plate is provided at a position recessed from an opening of said cylindrical body.

3. The color cathode-ray tube according to claim 1, wherein one or more said intermediate electrodes are provided between said focusing electrode and said anode electrode.

4. The color cathode-ray tube according to claim 1, wherein said intermediate electrode is provided with one or two electric field correcting electrode plates.

5. The color cathode-ray tube according to claim 1, wherein said electric field correcting electrode plate of said intermediate electrode is provided at a position deviated from a position corresponding to a potential of the intermediate electrode on a potential distribution axis determined by the potential of the focusing electrode, the potential of the intermediate electrode and the potential of the anode electrode, wherein said electric field correcting electrode plate positioned at said position provides a gentle slope transition between the potential of the focusing electrode and the anode electrode.

6. The color cathode-ray tube according to claim 1, wherein said intermediate voltage is a free potential induced by the focusing voltage and the anode voltage.

7. The color cathode-ray tube according to claim 1, wherein said dividing resistor includes a first terminal connected to said anode electrode, a second terminal connected to said focusing electrode, and a third terminal provided between said first terminal and said second terminal connected to said intermediate electrode.

8. The color cathode-ray tube according to claim 1, wherein said dividing resistor includes a first terminal connected to said anode electrode, a second terminal connected to ground, and a third terminal provided between said first terminal and said second terminal connected to said intermediate electrode.

9. The color cathode-ray tube according to claim 1, wherein said dividing resistor is formed to have a width constricted portion and a metal body is wound around said dividing resistor at its width constricted portion.

10. A color cathode-ray tube comprising:

a focusing electrode applied with a focusing voltage;

an anode electrode applied with an anode voltage; and an intermediate electrode disposed between said focusing electrode and said anode electrode and applied with an intermediate voltage between said focusing voltage and said anode voltage through an incorporated dividing resistor, wherein said incorporated dividing resistor is formed to have a width constricted portion and a metal body is wound around said incorporated dividing resistor at its width constricted portion, wherein said width constricted portion is a notch in said dividing resistor.

* * * * *